US007294813B2

(12) United States Patent
Ryu et al.

(10) Patent No.: US 7,294,813 B2
(45) Date of Patent: Nov. 13, 2007

(54) MICROWAVE OVEN HAVING AN ILLUMINATED GUIDE LINE

(75) Inventors: Han-gyu Ryu, Suwon-si (KR); Jun-soo Kim, Osan-si (KR); Hyang-ki Kim, Suwon-si (KR); Sang-hoon Paik, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 11 days.

(21) Appl. No.: 11/208,649

(22) Filed: Aug. 23, 2005

(65) Prior Publication Data

US 2006/0102624 A1 May 18, 2006

(30) Foreign Application Priority Data

Nov. 18, 2004 (KR) ..... 10-2004-0094670
Jan. 17, 2005 (KR) ..... 10-2005-0004185

(51) Int. Cl.
*H05B 6/68* (2006.01)

(52) U.S. Cl. ..... 219/758; 219/757

(58) Field of Classification Search ..... 219/758, 219/757, 702, 720, 722, 715, 724, 738, 391, 219/732, 745; 362/92; 126/19 R, 19 M, 126/21 A See application file for complete search history.

(56) References Cited

U.S. PATENT DOCUMENTS

| | | | | |
|---|---|---|---|---|
| 4,968,864 | A | 11/1990 | Doi et al. | |
| 5,036,435 | A * | 7/1991 | Tokuda et al. | 362/611 |
| 5,237,607 | A * | 8/1993 | Diamantis | 379/419 |
| 5,747,738 | A * | 5/1998 | Indoe | 174/66 |
| 5,836,669 | A * | 11/1998 | Hed | 362/92 |

FOREIGN PATENT DOCUMENTS

| | | | |
|---|---|---|---|
| EP | 0 872 996 | A | 10/1998 |
| EP | 1 341 316 | A | 9/2003 |
| JP | 5-240442 | A | 9/1993 |
| JP | 09230805 | A * | 9/1997 |
| KR | 1999-0039143 | A | 6/1999 |
| KR | 10-0276025 | B1 | 9/2000 |
| KR | 20-0299038 | Y1 | 1/2003 |
| WO | WO 00/55879 | A | 9/2000 |
| WO | WO 03/061253 | A | 7/2003 |

* cited by examiner

*Primary Examiner*—Quang Van
(74) *Attorney, Agent, or Firm*—Sughrue Mion, PLLC

(57) ABSTRACT

A microwave oven includes a main body, a door opening and closing the main body, and a control panel placed in one side of the main body and provided with a plurality of function operators. A guide line is provided on the control panel and lights up to guide manipulation order of the function operator.

5 Claims, 4 Drawing Sheets

MICROWAVE OVEN HAVING AN ILLUMINATED GUIDE LINE

CROSS-REFERENCE TO RELATED APPLICATIONS

This application claims the benefit of Korean Patent Application No. 2004-0094670, filed on Nov. 18, 2004, and Korean Patent Application No. 2005-0004185, filed on Jan. 17, 2005, in the Korean Intellectual Property Office, the disclosure of which are incorporated herein by reference.

BACKGROUND OF THE INVENTION

1. Field of the Invention

The present invention relates to a microwave oven, and more particularly, to a microwave oven capable of guiding a manipulation order of a function operator provided in a control panel thereof.

2. Description of the Related Art

Generally, a microwave oven uses a microwave to heat food or the like. Recently, there has been developed a microwave oven which has a general function using the microwave to defrost and warm up the food, a grill function using a heater, and a combination function using both the heater and the microwave.

Further, the microwave oven can comprise a convection heater and a convection fan behind a cooking compartment, thereby performing an oven function.

A conventional microwave oven comprises a main body; a door opening and closing the main body; and a control panel placed in a front of the main body and comprising a function operator to perform various functions (defrosting, warming up, oven-burning, etc.). The function operator provided in the control panel comprises a function selecting key to select a predetermined function, a detailed function setting key to set a detailed item of the selected function, and a starting key to start the selected function.

With this configuration, the following manipulation order of the microwave oven varies according to what function is selected through the function selection key. As the microwave oven has various functions, a user has to already know the manipulation order following a predetermined function selected through the function selection key. If a user doesn't know the following manipulation order, he/she should refer to a guide book or ask others about it whenever selecting the following detailed function.

To solve the foregoing problem, a microwave oven has been disclosed in Korean Patent Application No. 1997-59119, which not only indicates what buttons are capable of being manipulated after a user selects a predetermined function through the control panel, but also displays contents that correspond to the buttons that are capable of being manipulated.

However, in this conventional microwave oven, a user should check a lighting state of a lamp for a character displayed on a display portion and then set the detailed functions corresponding to the lighting state in sequence, thereby making the use of the oven less convenient. Also, the size of the character letter displayed on the display portion is too small to visually check easily with the naked eye, making this step inconvenient for a user.

SUMMARY OF THE INVENTION

The present invention is intended to solve the above-identified problems, as well as others not described above.

Accordingly, an apparatus consistent with the present invention provides a microwave oven capable of allowing a user to know the manipulation order of a function operator provided in a control panel.

The foregoing and/or other aspects of the present invention are also achieved by providing a microwave oven comprising a main body, a door opening and closing the main body, and a control panel placed in one side of the main body and provided with a plurality of function operators, the microwave oven further comprising a guide line provided on the control panel and lighting up to guide the manipulation order of the function operator.

According to an aspect of the present invention, the guide line is placed between the function operators.

According to an aspect of the present invention, the guide line is sequentially lit up corresponding to the manipulation order of the function operator.

According to an aspect of the present invention, the guide line is lit up when a function is selected through the function operator, and maintained to have a lighting state while cooking is performed.

According to an aspect of the present invention, the microwave oven further comprises a light emitting portion behind the guide line, the light emitting portion comprising a lamp supporting panel formed with a lamp accommodating groove corresponding to the guide line; a plurality of lamps accommodated in the lamp accommodating groove; and a diffusing film placed in front of the plurality of lamps.

According to an aspect of the present invention, the guide line is lit up when a function is selected through the function operator.

According to an aspect of the present invention, the guide line is maintained to have a lighting state while cooking is performed.

According to an aspect of the present invention, the guide line is lit up to guide the function operator that is capable of being manipulated when the door is closed.

According to an aspect of the present invention, the guide line is sequentially lit up corresponding to the manipulation order of the function operator.

BRIEF DESCRIPTION OF THE DRAWINGS

The above and/or other aspects and advantages of the present invention will become apparent and more readily appreciated from the following description of the embodiments, taken in conjunction with the accompany drawings of which.

DETAILED DESCRIPTION OF THE PREFERRED EMBODIMENT

Figure 1:
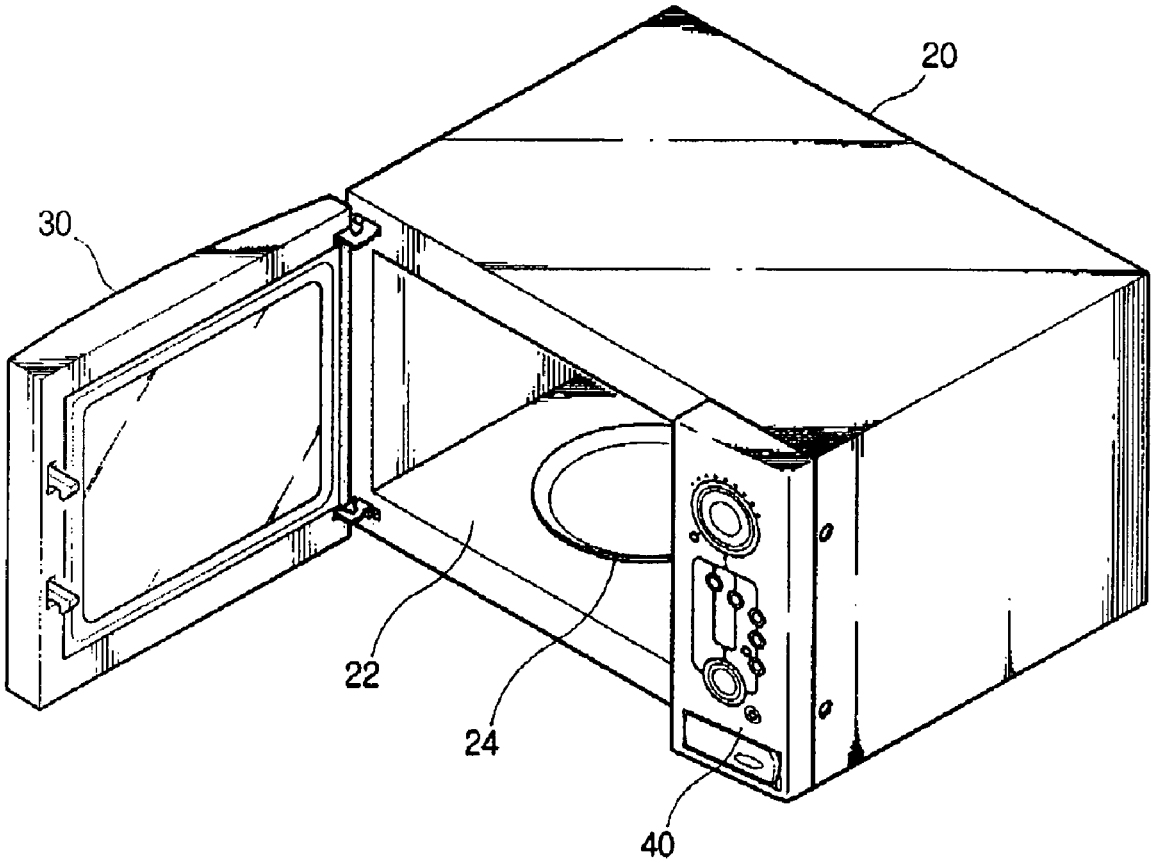
FIG. 1 is a perspective view of a microwave oven according to an embodiment of the present invention.

Reference will now be made in detail to exemplary embodiments of the present invention, examples of which are illustrated in the accompanying drawings, wherein like reference numerals refer to like elements throughout.

Figure 2:
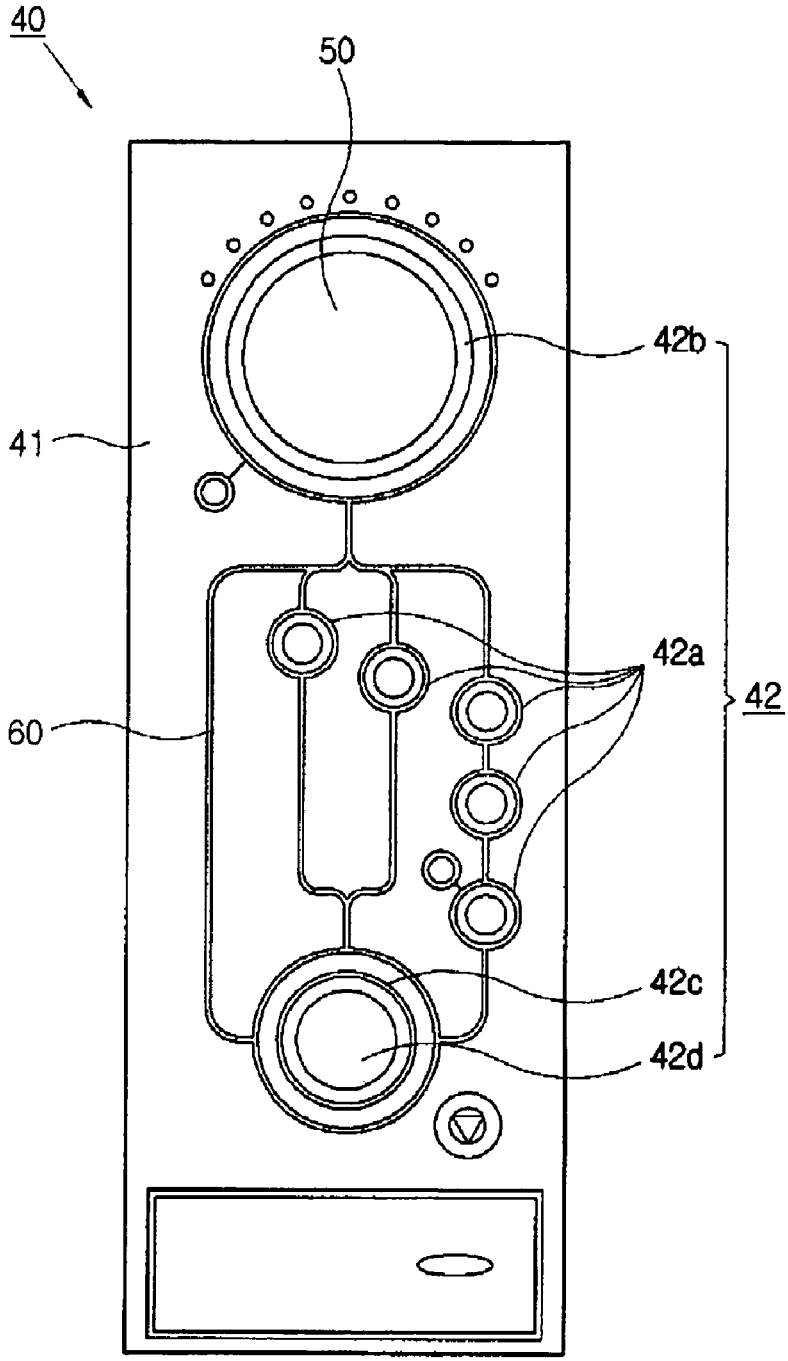
FIG. 2 is a front view showing an external appearance of a control panel provided in the microwave oven according to an embodiment of the present invention.
Figure 3:
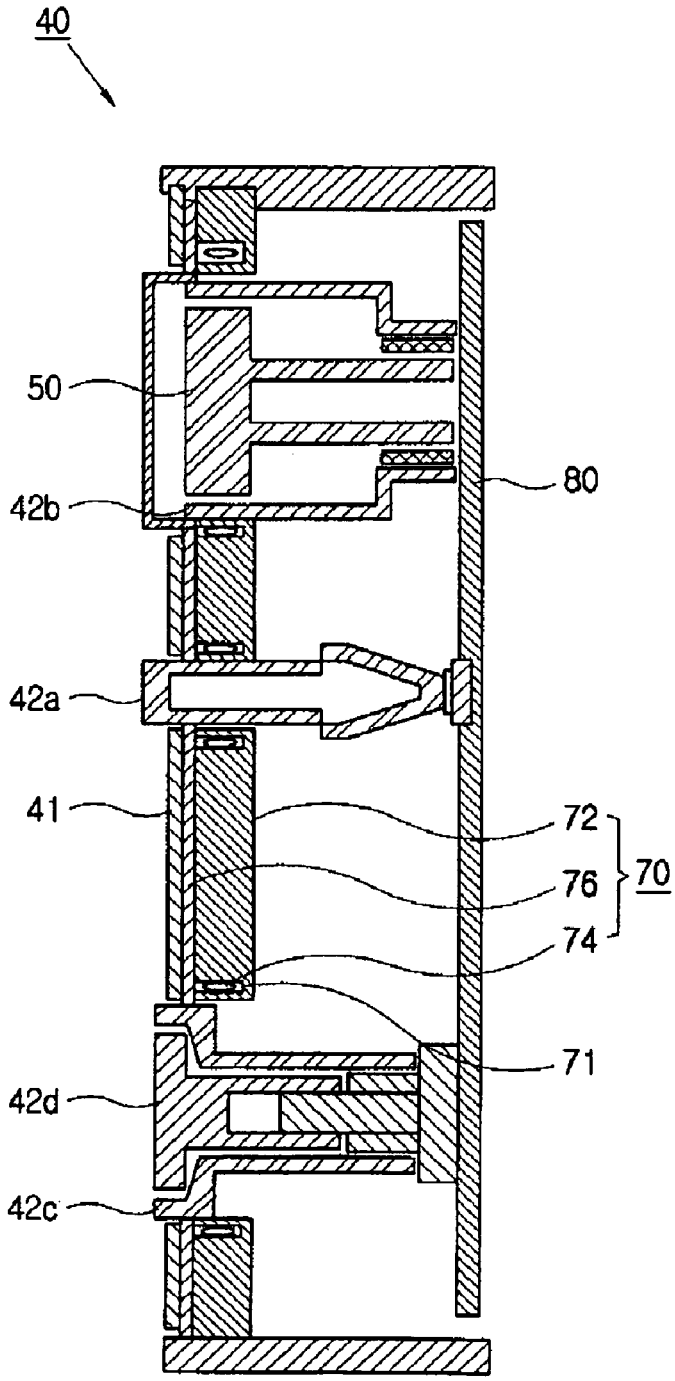
FIG. 3 is a sectional view illustrating an internal structure of the control panel provided in the microwave oven according to an embodiment of the present invention.

As shown in FIGS. 1 through 3, a microwave oven according to an embodiment of the present invention comprises a main body 20; a door 30 opening and closing the main body 20; and a control panel 40 provided in a predetermined side of the main body 20.

The main body 20 has a cooking compartment 22 to cook therein, and the door 30 is rotatably connected with a front of the main body 20 so as to open and close the main body 20.

The cooking compartment 22 of the main body 20 is provided with a tray 24, on which food to be cooked is put.

The control panel 40 is placed in a front of the main body 20, thereby allowing a user to easily manipulate operation of the microwave oven. Behind the control panel 40 is provided a plurality of components such as a magnetron to generate a high frequency wave to cook the food.

The control panel 40 comprises a front cover 41 shaped like a plate; a plurality of function operators 42 to operate various functions; and guide lines 60 placed between the plurality of function operators 42, for lighting up to guide the manipulation order of the function operators 42.

The function operators 42 comprise a plurality of function selecting key 42*a* allowing a user to select a predetermined function (defrosting, warming up, oven-burning, etc.); a detailed function setting key 42*b*, 42*c* to set detailed items of the function selected through the function selecting key 42*a*; and a starting key 42*d* to start the selected function.

The function selecting key 42*a* is preferably bright using a fluorescent material, a lamp or the like, so that a user can easily check the function selecting key 42*a* even though it is in a dark room. Further, the number of function selecting keys 42*a* varies corresponding to functions provided in the microwave oven.

The detailed function setting keys 42*b* and 42*c* are placed in a top side and a bottom side of the front cover 41, respectively. For example, the detailed function setting key 42*b* placed in the top side of the front cover 41 is a dial knob mounted on a printed circuit board 80, thereby allowing a user to input a heating time or the like. Further, the detailed function setting key 42*c* placed in the bottom side of the front cover 41 can be left or right rotated, thereby allowing a user to adjust the output power of the microwave oven.

The detailed functions, which can be set through the detailed function setting keys 42*b* and 42*c*, includes various items such as the heating time, weight, heating temperature, etc.

The starting key 42*d* can be selected after the detailed functions are completely set through the detailed function setting keys 42*b* and 42*c*. That is, when the detailed functions are completely set through the detailed function setting keys 42*b* and 42*c*, the starting key 42*d* lights up or flashes to let a user to know that a starting operation is allowed.

The guide line 60 is placed between the function operators 42 to make a user easily check the manipulation order. That is, the guide line 60 connects the function selecting key 42*a* with the detailed function setting keys 42*b* and 42*c*. The guide line 60 is transparent or translucent, thereby allowing light to pass therethrough. According to an embodiment of the present invention, a light emitting portion 70 is placed behind the guide line 60, thereby emitting light, so that the guide line 60 is illuminated.

Further, the guide line 60 lights up corresponding to the function selected through the function operator 42, thereby guiding the manipulation order.

The light emitting portion 70 comprises a lamp supporting panel 72 formed with a lamp accommodating groove 71 corresponding to the guide line 60; a plurality of lamps 74 accommodated in the lamp accommodating groves 71; and a diffusing film 76 placed in front of the plurality of lamps 74. For example, the lamp 74 is a light emitting diode (LED). Here, the diffusing film 76 uniformly diffuses the light emitted from the lamp 74, and enhances the lighting efficiency of the lamp 74.

The light emitting portion 70 lights up or flashes according to controls of a microcomputer (not shown), thereby guiding a user to select a detailed item following after a predetermined function is selected. Here, the light emitting portion 70 may have various configurations as long as it can emit light outside through the guide line 60.

The guide line 60 may appear only when the light emitting portion 70 lights on, and disappear when the light emitting portion 70 lights off. That is, when the light emitting portion 70 is turned off, the guide line 60 may be indistinguishable from the front cover 71. Alternatively, the guide line 60 may be distinguishable from the front cover 41 independently of lighting on/off the light emitting portion 70.

The guide line 60 is placed between all function operators 42 to guide the manipulation order corresponding to various functions, but only a portion of the whole guide line 60 lights up corresponding to a predetermined function when the predetermined function is selected through the function selecting key 42*a*.

The guide line 60 is selectively maintained to light up (on) or light out (off) while food is cooked on the basis of the selected function. Alternatively, the guide line 60 may be continuously maintained to light up or flash, thereby allowing a user to reconfirm a selected cooking process while the food is cooked.

The guide line 60 may have various shapes and arrangements as long as it can guide the manipulation order of the function operator 42.

Preferably but not necessarily, the guide line 60 stepwise lights up according to the manipulation order of the function operator 42. That is, when a predetermined function is selected, the guide line 60 sequentially lights up to indicate the following detailed items. Therefore, every guide line 60 corresponding to a predetermined cooking process is maintained to have a lighting state in the end. Alternatively, the guide line 60 may be wholly or partially lit up corresponding to a predetermined cooking process.

The display portion 50 displays an operating state of the microwave oven externally.

Figure 4:
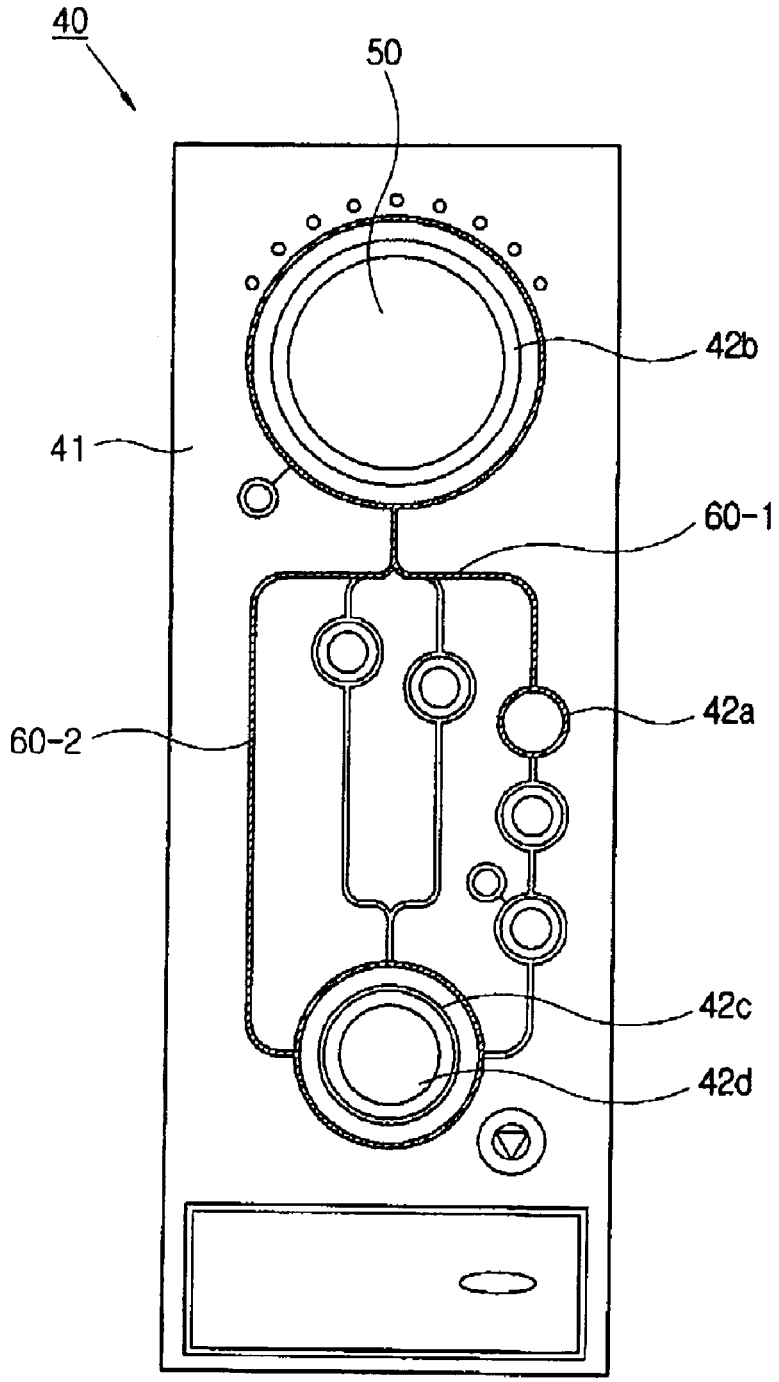
FIG. 4 is a front view showing a lighting state of a guide line depending on manipulation of a function operator provided in the control panel of the microwave oven according to an embodiment of the present invention.

With this configuration, controlling the microwave oven through the control panel will be described with reference to FIG. 4.

First, a user opens the door 30, puts food in the cooking compartment 22 of the main body 20, and closes the door 30. Then, the guide line 60 around the manipulable function operator 42 provided in the front cover 41 of the control panel 40 lights up and waits for a user's selection.

When a user selects a predetermined function selecting key 42*a*, the guide line 60-1 corresponding to the selected function lights up and indicates that the following detailed function setting key 42*b* is capable of being manipulated (manipulable). Then, a user inputs a cooking time through the dial operation of the detailed function setting key 42*b*. At this time, the cooking time inputted through the detailed function setting key 42*b* is displayed on the display portion 50.

When the input of the cooking time is completed, the guide line 60-2 lights up and indicates that the following detailed function setting key 42*c* is manipulable. Then, a user adjusts the output power of the microwave oven through the dial operation.

When the output power is completely adjusted through the detailed function setting key 42*c*, the starting key 42*b* lights up and indicates that a starting operation is allowed. Thus, a user can follow the manipulation order corresponding to a predetermined function, thereby implementing a desired cooking process.

In the foregoing embodiment, a portion of the guide line 60 is lit up to guide the manipulable function operator at the same time when the door 30 is closed. Alternatively, the guide line 60 may be lit up when a user selects the function operator 42.

As described above, the present invention provides a microwave oven comprising a guide line allowing a user to know manipulation order corresponding to each function of a function operator, thereby enhancing the functionality and the usability of the microwave oven.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven, comprising:

a main body;

a door for opening and closing the main body;

a control panel placed in one side of the main body and provided with a plurality of function operators; and a guide line provided on the control panel, wherein said guide line lights up to guide a manipulation order of the plurality of function operators, wherein the guide line is disposed between the plurality of function operators, wherein the guide line is sequentially lit up corresponding to the manipulation order of the plurality of function operators.

2. The microwave oven according to claim 1, further comprising a light emitting portion behind the guide line, the light emitting portion comprising:

a lamp supporting panel formed with a lamp accommodating groove corresponding to the guide line;

a plurality of lamps accommodated in the lamp accommodating groove; and a diffusing film placed in front of the plurality of lamps.

3. The microwave oven according to claim 1, wherein the guide line is lit up when a function is selected through one or more of the plurality of function operators.

4. The microwave oven according to claim 3, wherein the guide line is maintained to have a lighting state while cooking is performed.

5. The microwave oven according to claim 1, wherein the guide line is lit up to guide one or more of the plurality of function operators that is manipulable when the door is closed.

* * * * *